US008250988B2

(12) United States Patent
Heitmann

(10) Patent No.: US 8,250,988 B2
(45) Date of Patent: Aug. 28, 2012

(54) PROJECTILE HAVING A GUIDE SABOT AND PUSHER PLATE WITH AN ACCELERATION-OPTIMIZED OPENING

(75) Inventor: Thomas Heitmann, Unterlüss (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 234 days.

(21) Appl. No.: 12/673,485

(22) PCT Filed: Jul. 16, 2008

(86) PCT No.: PCT/EP2008/005804
§ 371 (c)(1),
(2), (4) Date: Feb. 12, 2010

(87) PCT Pub. No.: WO2009/018905
PCT Pub. Date: Feb. 12, 2009

(65) Prior Publication Data

US 2011/0197780 A1 Aug. 18, 2011

(30) Foreign Application Priority Data

Aug. 9, 2007 (DE) ..... 10 2007 037 738

(51) Int. Cl.
*F42B 14/06* (2006.01)

(52) U.S. Cl. ..... 102/522; 102/520

(58) Field of Classification Search ..... 102/502, 102/520–528
See application file for complete search history.

(56) References Cited

U.S. PATENT DOCUMENTS 3,745,926 A * 7/1973 Mertz et al. ..... 102/523
4,296,687 A * 10/1981 Garrett ..... 102/518
4,360,954 A 11/1982 Burns et al.
4,459,894 A 7/1984 Bunch
4,505,204 A * 3/1985 Wikstrom ..... 102/523
(Continued)

FOREIGN PATENT DOCUMENTS

DE 2 227 655 1/1973
(Continued)

OTHER PUBLICATIONS

Office Action issued in co-pending U.S. Appl. No. 12/733,186, mailed Jun. 27, 2011.
(Continued)

*Primary Examiner* — Michael Carone
*Assistant Examiner* — Joshua Freeman
(74) *Attorney, Agent, or Firm* — Griffin & Szipl, P.C.

(57) ABSTRACT

The invention relates to a subcaliber projectile, particularly for a dart projectile, having a resistance-stabilizing, conically designed guide mechanism having a frustum-shaped recess, wherein a guide cage has a substantially hollow cylindrical design in which a propulsion element is integrated therein on a rear side. To allow the propulsion element to be produced in a simple fashion and the guide cage to be lighter weight than comparable known drive cages, the propulsion element is designed substantially only as a disk-shaped metal plate extending transverse to the longitudinal axis of the guide cage, wherein the drive element is mounted on an edge in an annular groove-shaped recess of the inner wall of the guide cage, wherein the disk-shaped metal plate comprises a central through hole, the diameter of which is as large as possible, but smaller than the maximum diameter of the frustum-shaped recess of the guide mechanism.

12 Claims, 2 Drawing Sheets

U.S. PATENT DOCUMENTS

| | | | | | |
|---|---|---|---|---|---|
| 4,590,862 | A | | 5/1986 | Grabarek et al. | |
| 4,709,638 | A | | 12/1987 | Broden et al. | |
| 4,757,766 | A | | 7/1988 | Ruffle et al. | |
| 4,850,280 | A | | 7/1989 | Wallow et al. | |
| 4,854,242 | A | * | 8/1989 | Katzmann | 102/522 |
| 4,982,669 | A | * | 1/1991 | Bisping et al. | 102/520 |
| 5,052,305 | A | * | 10/1991 | Chiarelli et al. | 102/522 |
| 5,404,816 | A | | 4/1995 | Burri | |
| 5,477,786 | A | | 12/1995 | Leeker et al. | |
| 5,481,981 | A | * | 1/1996 | Sippel et al. | 102/522 |
| 5,635,660 | A | | 6/1997 | McGovern | |
| 5,640,054 | A | | 6/1997 | McGovern | |
| 7,934,456 | B1 | * | 5/2011 | Heitmann et al. | 102/522 |
| 2010/0000439 | A1 | * | 1/2010 | Baumann et al. | 102/521 |
| 2010/0139518 | A1 | * | 6/2010 | Baumann et al. | 102/523 |

FOREIGN PATENT DOCUMENTS

| | | | | |
|---|---|---|---|---|
| DE | 33 189 72 | A1 | | 12/1983 |
| DE | 36 35 738 | A1 | | 5/1988 |
| DE | 37 35 481 | A1 | | 5/1989 |
| DE | 43 30 417 | C2 | | 2/1998 |
| DE | 102007038486 | A1 | * | 2/2009 |
| EP | 0 417 012 | A1 | | 3/1991 |
| EP | 0 471 616 | A1 | | 2/1992 |
| EP | 0 645 600 | A | | 3/1995 |
| FR | 2 642 161 | A | | 7/1990 |
| GB | 2 121 146 | A | | 12/1983 |

OTHER PUBLICATIONS

International Search Report, issued in corresponding application No. PCT/EP2008/006110, completed Dec. 22, 2008, mailed Jan. 1, 2009.

International Search Report, issued in corresponding application PCT/EP2008/005804, completed Nov. 21, 2008, mailed Dec. 1, 2008.

* cited by examiner

PROJECTILE HAVING A GUIDE SABOT AND PUSHER PLATE WITH AN ACCELERATION-OPTIMIZED OPENING

This is a National Phase Application in the United States of International Patent Application No. PCT/EP2008/005804 filed Jul. 16, 2008, which claims priority on German Patent Application No. DE 10 2007 037 738.1, filed Aug. 9, 2007. The entire disclosures of the above patent applications are hereby incorporated by reference.

FIELD OF THE INVENTION

The invention relates to a projectile, in particular, a sub-caliber dart projectile having a drag-stabilizing, conical fin assembly with a truncated-conical recess.

BACKGROUND OF THE INVENTION

In practice, sub-caliber projectiles have a discarding sabot in order to pull the projectile through the weapon barrel, and, therefore, to transmit force from the discarding sabot to the projectile. A discarding sabot such as this is disclosed, for example, in DE 43 30 417 C2. This discarding sabot has a segmented, essentially hollow-cylindrical guide sabot and a driving element that is arranged on the guide sabot at the rear. The driving element is, in this case, formed by a metal plate that has essentially the same contour as the truncated-conical recess in the fin assembly, and has a relatively small aperture hole in order to ignite the tracer charge, which can be initiated by pressure, and is arranged at the rear in the projectile when the projectile is fired. This known discarding sabot has the disadvantage in that the production of the driving element is relatively complex and in that this driving element is heavy (thus, the proportion of dead load is therefore high).

DE 37 35 481 A1 furthermore discloses a sub-caliber dart projectile having an end area in the form of a solid cone, which is arranged in a discarding sabot which, at the rear, contains a solid metal plate, in the form of a disk, as a driving element. This metal plate is screwed into a segmented, cylindrical guide sabot. This known driving element is also heavy and requires a relatively large amount of assembly effort for connection to the guide sabot.

Finally, DE 33 18 972 A1 discloses a discarding sabot for a sub-caliber spinning projectile, which has a guide sabot and a driving element that is connected to it, and is in the form of a cup. In this case, the base of the driving element has a relatively thick wall and has an aperture bore so that the propellant gases, on firing the corresponding munition, can act directly on the rear planar end surface of the projectile. The side walls of the driving element extend over more than 20% of the length of the entire spinning projectile. This driving element, in the form of a cup, is also relatively complex to produce and is heavy.

The present invention is based on the object of specifying a possible way to produce the driving element easily and so that its weight is lighter than that of known comparable discarding sabots.

SUMMARY OF THE INVENTION

According to the invention, these objects of the invention are achieved by the features of a first embodiment pertaining to a sub-caliber projectile (1; 1'), in particular for a dart projectile (2; 2'), having a drag-stabilizing, conical fin assembly (4, 4') with a truncated-conical recess (5), wherein the sub-caliber projectile has the following features: (a) the projectile (1, 1') has a segmented, essentially hollow-cylindrical guide sabot (7) and a driving element (8; 80), which is connected to the guide sabot (7) at the rear; (b) the driving element (8; 80) is essentially in the form of a metal plate, which extends transversely with respect to the longitudinal axis (9) of the discarding sabot (7; 7'), and is in the form of a disk and is mounted at the edge in a recess (10), which is in the form of a annular groove, in the inner wall of the guide sabot (7); (c) the driving element (8; 8') has a central aperture hole (11), whose diameter (12) is as large as possible but is less than the maximum diameter (13) of the truncated-conical recess (5) in the fin assembly (4). Further particularly advantageous refinements of the invention are disclosed in the additional embodiments.

More specifically, in accordance with a second embodiment of the present invention, the first embodiment is modified so that, if the fin assembly (4') is in the form of a slotted conical fin assembly, the diameter (12) of the aperture hole (11) in the driving element (8'), which is in the form of a disk, is less than the maximum diameter of that area of the truncated-conical recess (5) in the fin assembly (4), which is not provided with slots. In accordance with a third embodiment of the invention, the first embodiment and the second embodiment are further modified so that the driving element (8; 8'), which is in the form of a disk, has a recess (14) on its side facing the fin assembly (4; 4') of the corresponding projectile, for interlocking accommodation of the rear end area of the fin assembly (4; 4'). In accordance with a fourth embodiment of the present invention, the first embodiment, the second embodiment and the third embodiment are further modified so that the driving element (8; 8'), which is in the form of a disk, is composed of a lightweight metal.

In accordance with a fifth embodiment of the present invention, the first embodiment, the second embodiment, the third embodiment and the fourth embodiment, are further modified so that the hollow-cylindrical guide sabot (7) is composed of plastic, preferably of fiber-reinforced polyamide. In accordance with a sixth embodiment of the invention, the first embodiment, the second embodiment, the third embodiment, the fourth embodiment, and the fifth embodiment are further modified so that the driving element (8'), which is in the form of a disk, has a tubular attachment (15) at the rear for force-fitting connection to a casing cover (16), in order to connect the discarding sabot (7') to a projectile drive part.

In brief, the invention is essentially based on the idea that a driving element is arranged behind the projectile and is designed such that it pushes the projectile through a weapon tube or barrel, and is not drawn out of the weapon barrel by a discarding sabot, in the known manner. The driving element is simply in the form of a preferably metal plate that extends transversely with respect to the longitudinal axis of a sabot, which acts only as a guide sabot. The metal plate that is in the form of a disk is mounted at the edge in a recess, which is in the form of an annular groove, in the inner wall of the guide sabot, wherein the metal plate, which is in the form of a disk, has a central aperture hole whose diameter is as large as possible, but is less than the maximum diameter of the internal cone of the truncated-conical recess in the fin assembly. The inclusion of a pusher plate constructed in this way uses the gas pressure for acceleration of the projectile in addition to the plate, and drives the projectile through the weapon barrel. The guide sabot, therefore, now acts only as a guide for the sub-caliber projectile and can be made lighter in weight than conventional discarding sabots. Particularly, in the case of blank projectiles, this means that lighter-weight blank projectiles can be made available.

A driving element, such as this in the form of a separate annular disk, is produced easily and is light in weight. Furthermore, particularly when using a guide sabot composed of plastic, it can be connected in a simple manner to the material used for production of the guide sabot by extrusion coating its edge with the material that is used for production of the guide sabot. The aperture hole, which is as large as possible, in the annular disk results in the gas pressure forces acting on a considerably larger area of the conical fin assembly than if it were to act only on a closed metal plate in the form of a disk.

If a slotted conical fin assembly is used as the fin assembly, in which slots that are in the form of grooves and are inclined at the edge are incorporated in order to provide the projectile with a certain compensating spin after being fired, then the diameter of the aperture hole in the metal plate, which is in the form of a disk, can be chosen so that it is smaller than the maximum diameter of the truncated-conical recess in the fin assembly, which is not provided with slots. This configuration avoids the possibility of propellant charge gases emerging through the slots, which are in the form of grooves, at the side when the discarding sabot projectile is fired.

In order to ensure good centering of the sub-caliber projectile, it has been found to be advantageous for the metal plate, which is in the form of a disk, to have a recess on its side facing the fin assembly of the corresponding projectile, for interlocking accommodation of the rear end area of the fin assembly. The metal plate, which is in the form of a disk, can preferably be composed of a lightweight metal, for example, an aluminum alloy or a magnesium alloy, or else may be composed of steel. It can be used not only for acceleration of sub-caliber live projectiles, but also for acceleration of sub-caliber blank projectiles.

In the case of projectiles in which the guide sabot is connected to the casing of the drive part via a casing cover, it is preferable for the metal plate, which is in the form of a disk, to have a tubular attachment at the rear for force-fitting connection to the casing cover, with the attachment being extrusion-coated with the material of the casing cover. Thus, a type of pusher plate with an acceleration-optimized opening is proposed.

BRIEF DESCRIPTION OF THE DRAWINGS

Further details and advantages of the present invention will become evident from the following exemplary embodiments, which will be explained with reference to figures, in which.

DETAILED DESCRIPTION OF THE INVENTION

Figure 1:
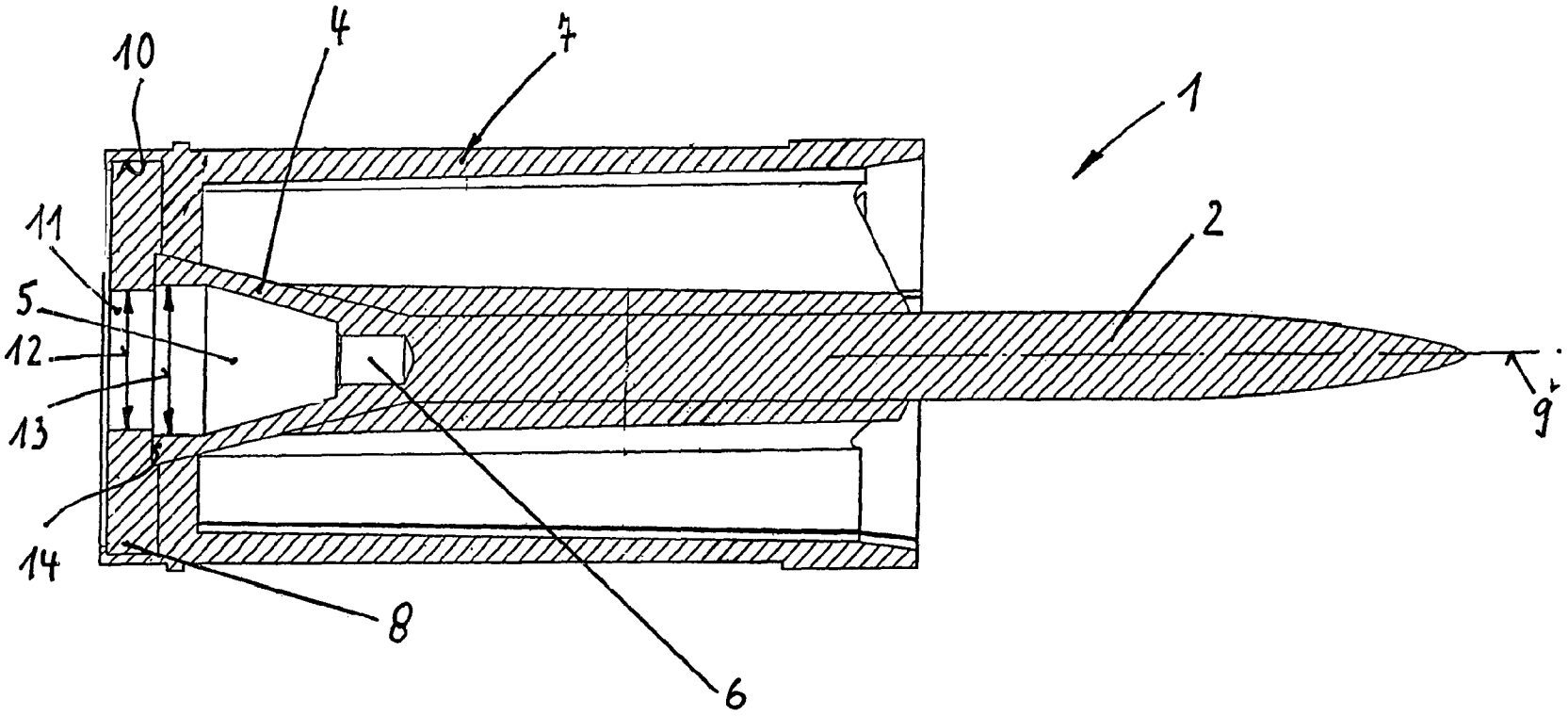
FIGS. 1 and 2 show longitudinal sections through two exemplary embodiments of discarding sabots, according to the invention, with dart projectiles arranged in them.

In FIG. 1, 1 denotes a projectile which, for example, is a 120 mm blank projectile that can be fired from a tank gun. The projectile has a sub-caliber dart projectile 2, for example, composed of steel, and a sabot 7 that partially surrounds the dart projectile 2. At the rear, the dart projectile 2 has a conical fin assembly 4, with a truncated-conical recess 5. In addition, a tracer charge 6 is located in the rear end area of the dart projectile 2, and is preferably adhesively bonded therein.

As a guide sabot for the projectile 1, the sabot 7 is essentially composed of an essentially hollow-cylindrical plastic, for example, a glass-fiber-reinforced plastic, comprising two half shells (segments). A driving element 8, which is surrounded by the guide sabot 7, is located at the rear of the guide sabot 7. The driving element 8 is formed by a metal plate (for example, composed of an aluminum alloy), which extends transversely with respect to the longitudinal axis 9 of the guide sabot 7 (and, therefore, of the dart projectile 2 as well), and is in the form of a disk. The driving element 8 is mounted at the edge of the guide sabot 7 in a recess 10, which is in the form of a annular groove, formed in the guide sabot 7, for example, by extrusion coating with the material of the guide sabot 7.

The driving element 8, which is in the form of a disk, has a central aperture hole 11 whose diameter 12 is as large as possible, but is less than the maximum diameter 13 of the truncated-conical recess 5 in the fin assembly 4. As can seen from FIG. 1, the driving element 8, which is in the form of a disk, has a recess 14 on its side facing the fin assembly 4 of the dart projectile 2, for interlocking accommodation of the rear end area of the fin assembly 4.

After the discarding sabot projectile 1 has been fired, the propellant charge gases that are formed in the corresponding weapon barrel push against the driving element 8, which is in the form of a disk, and against the inner walls of the conical fin assembly 4, as a result of which the dart projectile 2 is accelerated both indirectly via the driving element 8 and directly by the propellant charge gases acting on the inner walls of the fin assembly 4.

Figure 2:
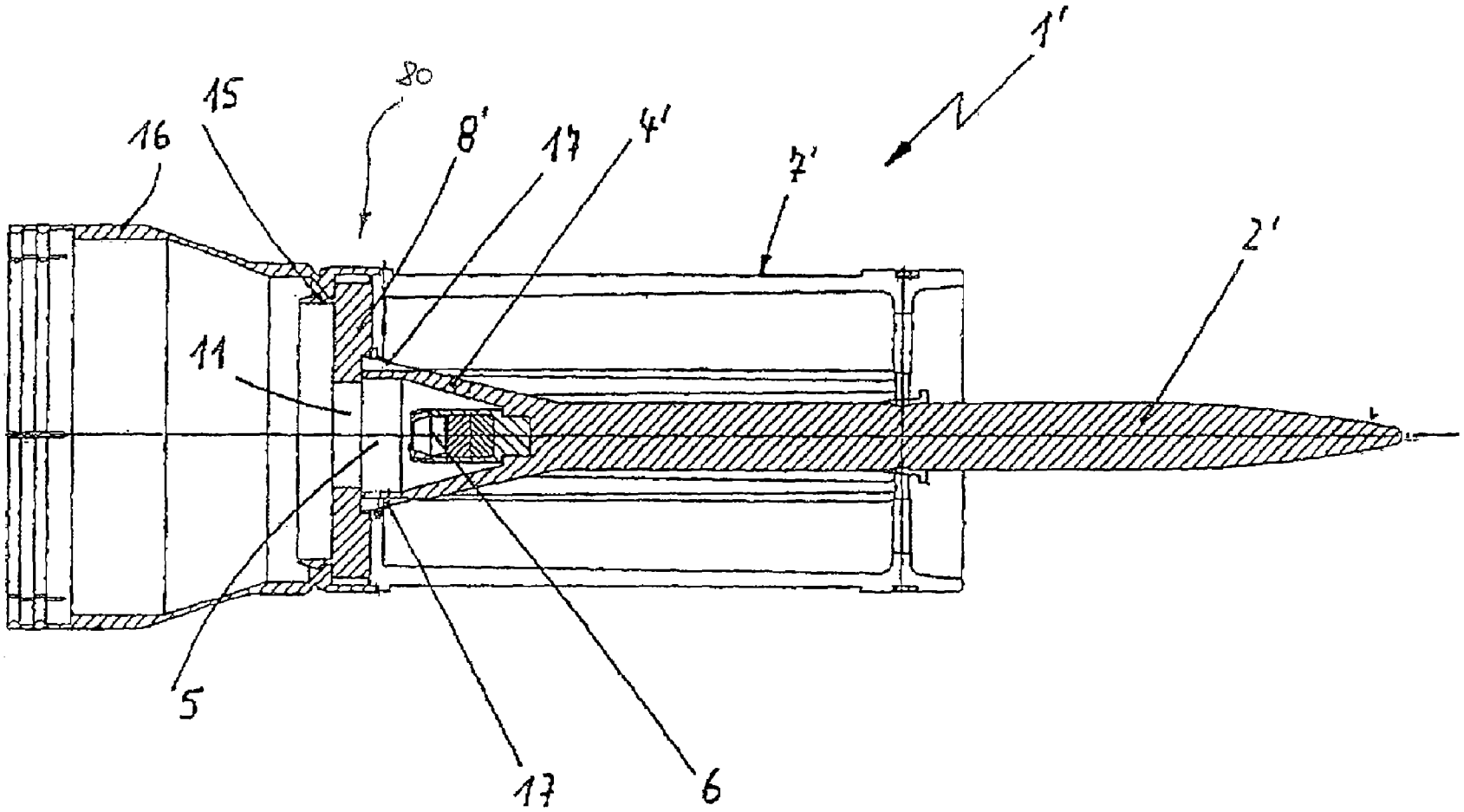

FIG. 2 shows a further exemplary embodiment of a projectile 1' with a guide sabot 7' according to the invention. In this case, the same reference symbols have been used for those components that carry out the same function as the components in the exemplary embodiment illustrated in FIG. 1. As can be seen from FIG. 2, the driving element, which is identified by the reference symbol 80 there, has a tubular attachment 15 at the rear on the metal plate 8', which is in the form of a disk. A casing cover 16, which is composed of plastic or rubber, is molded onto this attachment 15 and, during the assembly of the prefabricated discarding sabot projectile 1', is connected to the outer surface of the casing of a projectile drive part, which is not illustrated, in a manner which is known per se.

Furthermore, the reference symbol 17 denotes slots, which are in the form of grooves and are incorporated on the outside in the edge of the conical fin assembly 4', in order to produce a compensating spin during the flight of the dart projectile 2'. However, these slots 17 do not extend into the truncated-conical recess 5, which means that the diameter 12 of the aperture hole 11 is not influenced by these slots 17.

LIST OF REFERENCE SYMBOLS

1,1' Projectile
2,2' Projectile, dart projectile
4,4' Fin assembly, conical fin assembly
5 Truncated-conical recess
6 Tracer charge
7,7' Guide sabot
8 Driving element, metal plate
8' Metal plate
9 Longitudinal axis
10 Recess in the form of an annular groove
11 Aperture hole
12 Diameter (aperture hole)
13 Maximum diameter (truncated-conical recess)
14 Recess
15 Attachment
16 Casing cover
17 Slot
80 Driving element

The invention claimed is:

1. A sub-caliber projectile for a dart projectile, having a drag-stabilizing, conical fin assembly provided with a truncated-conical recess, wherein the sub-caliber projectile comprises:

(a) a segmented, essentially hollow-cylindrical guide sabot; and (b) a driving element connected to the guide sabot at a rear portion of the sub-caliber projectile;

wherein the driving element is a flat, annular metal disk having first and second flat, parallel major surfaces that both extend transversely with respect to a longitudinal axis of the guide sabot;

wherein the disk is mounted at an edge of the sub-caliber projectile in a recess, wherein the recess is an annular groove formed in an inner wall of the guide sabot;

wherein the disk has a central aperture hole extending between the first and second flat, parallel major surfaces; and wherein the diameter of the central aperture hole is as large as possible but is less than a maximum diameter of the truncated-conical recess formed in the fin assembly.

2. The projectile as claimed in claim 1, wherein the fin assembly is a slotted conical fin assembly, and wherein the diameter of the central aperture hole formed in the disk is less than the maximum diameter of that portion of the truncated-conical recess formed in the fin assembly that is not provided with slots.

3. The projectile as claimed in claim 2, wherein the disk has a recess disposed on a side of the driving element facing the fin assembly of the dart projectile for interlocking accommodation of a rear end area of the fin assembly.

4. The projectile as claimed in claim 3, wherein the disk comprises a lightweight metal.

5. The projectile as claimed in claim 2, wherein the disk comprises a lightweight metal.

6. The projectile as claimed in claim 1, wherein the disk has a recess disposed on a side of the disk facing the fin assembly of the dart projectile for interlocking accommodation of a rear end area of the fin assembly.

7. The projectile as claimed in claim 6, wherein the disk comprises a lightweight metal.

8. The projectile as claimed in claim 1, wherein the disk comprises a lightweight metal.

9. The projectile as claimed in claim 1, wherein the hollow-cylindrical guide sabot comprises plastic.

10. The projectile as claimed in claim 9, wherein the plastic of the hollow-cylindrical guide sabot is a fiber-reinforced polyamide.

11. The projectile as claimed in claim 1, wherein the first and second major surfaces extend radially inward from an outer peripheral edge of the disk.

12. A sub-caliber projectile for a dart projectile, having a drag-stabilizing, conical fin assembly provided with a truncated-conical recess, wherein the sub-caliber projectile comprises:

(a) a segmented, essentially hollow-cylindrical guide sabot; and (b) a driving element connected to the guide sabot at a rear portion of the sub-caliber projectile;

wherein the driving element is a metal disk that extends transversely with respect to a longitudinal axis of the guide sabot, wherein the disk is mounted at an edge of the sub-caliber projectile in a recess, wherein the recess is an annular groove formed in an inner wall of the guide sabot;

wherein the disk has a central aperture hole, wherein the diameter of the central aperture hole is as large as possible but is less than a maximum diameter of the truncated-conical recess formed in the fin assembly, and wherein the disk has a tubular attachment disposed at a rear portion of the disk for providing a force-fitting connection to a casing cover in order to connect the guide sabot to a projectile drive part.

* * * * *